US006059615A

United States Patent [19]

Pendleton et al.

[11] Patent Number: 6,059,615

[45] Date of Patent: May 9, 2000

[54] MODULAR CABLE TO BOARD POWER CONNECTOR

[75] Inventors: Christopher S. Pendleton, Carlisle; Ray C. Doutrich, Lebanon; Stuart C. Stoner, Lewisberry, all of Pa.

[73] Assignee: Berg Technology, Inc., Reno, Nev.

[21] Appl. No.: 09/101,889

[22] PCT Filed: Jan. 31, 1997

[86] PCT No.: PCT/US97/01787

§ 371 Date: Jul. 17, 1998

§ 102(e) Date: Jul. 17, 1998

[87] PCT Pub. No.: WO97/28580

PCT Pub. Date: Aug. 7, 1997

[51] Int. Cl.[7] ..... H01R 9/22

[52] U.S. Cl. ..... 439/717; 439/701; 439/594; 439/368

[58] Field of Search ..... 439/717, 716, 439/712, 701, 368, 594

[56] References Cited

U.S. PATENT DOCUMENTS

| | | | |
|---|---|---|---|
| 3,042,895 | 7/1962 | Bonhomme | 439/701 |
| 3,200,367 | 8/1965 | Blanchenot | 439/716 |
| 3,377,614 | 4/1968 | Powell et al. | 439/716 |
| 3,439,313 | 4/1969 | Fischer et al. | 439/717 |
| 3,771,104 | 11/1973 | Clark | 439/415 |
| 3,824,553 | 7/1974 | Glover et al. | 439/717 |
| 4,070,086 | 1/1978 | Trafford | 439/717 |
| 4,090,764 | 5/1978 | Malsby et al. | 439/471 |
| 4,269,470 | 5/1981 | Ustin | 439/712 |
| 4,343,528 | 8/1982 | Lucius et al. | 439/601 |
| 4,425,018 | 1/1984 | Stenz | 439/716 |
| 4,469,393 | 9/1984 | Chewning, Jr. et al. | 439/717 |
| 4,580,861 | 4/1986 | Kaley | 439/594 |
| 4,611,879 | 9/1986 | Bullard | 439/717 |
| 4,620,756 | 11/1986 | Gatti et al. | 439/368 |
| 4,753,614 | 6/1988 | Weiner | 439/717 |
| 4,790,763 | 12/1988 | Weber et al. | 439/65 |
| 4,797,123 | 1/1989 | Weber | 439/717 |
| 4,820,169 | 4/1989 | Weber et al. | 439/717 |
| 4,898,549 | 2/1990 | Nakama et al. | 439/715 |
| 5,122,077 | 6/1992 | Maejima et al. | 439/398 |
| 5,194,018 | 3/1993 | Lopata et al. | 439/710 |
| 5,286,225 | 2/1994 | Tsuji | 439/752 |
| 5,288,250 | 2/1994 | Sumida | 439/717 |
| 5,288,251 | 2/1994 | Sumida | 439/717 |
| 5,295,870 | 3/1994 | Rei et al. | 439/717 |
| 5,320,564 | 6/1994 | Anderson | 439/716 |
| 5,351,391 | 10/1994 | Doutrich et al. | 29/758 |
| 5,385,490 | 1/1995 | Demeter et al. | 439/579 |
| 5,487,677 | 1/1996 | Hoffner | 439/701 |
| 5,551,896 | 9/1996 | Hess et al. | 439/717 |
| 5,584,728 | 12/1996 | Cheng | 439/637 |
| 5,632,643 | 5/1997 | Shepherd et al. | 439/368 |

FOREIGN PATENT DOCUMENTS

| | | | |
|---|---|---|---|
| 0152 743 | 1/1985 | European Pat. Off. . | |
| 1356162 | 2/1962 | France | 439/717 |
| 1465494 | 9/1969 | Germany | 439/717 |
| 1665371 | 10/1969 | Germany | 439/717 |
| 1765685 | 8/1971 | Germany | 439/717 |
| 2420047 | 11/1975 | Germany | 439/717 |
| 3406434 A1 | 8/1985 | Germany . | |
| 3627899 C1 | 2/1988 | Germany . | |
| 6-275336 | 12/1993 | Japan . | |
| 1343531 | 1/1971 | United Kingdom . | |

*Primary Examiner*—Paula Bradley
*Assistant Examiner*—Tho D. Ta
*Attorney, Agent, or Firm*—Brian J. Hamilla; M. Richard Page

[57] ABSTRACT

An element of an electrical connector in which a plurality of axial segments are positioned in side by side relation. A transverse passageway extends through the axial segments and a rail is positioned in the transverse passageway to link the segments together. A latch is fixed within an end segment to lock the rail in place. The segments may be power modules or signal modules. The number and type of power modules used may be selected based on specific power requirements.

5 Claims, 4 Drawing Sheets

MODULAR CABLE TO BOARD POWER CONNECTOR

BACKGROUND OF THE INVENTION

1. Field of the Invention

This invention relates to electrical connectors and more particularly to cable to board power connectors.

2. Brief Description of Prior Developments

Cable to board power connectors are know in the art. Such connectors may be adapted to relatively high power uses while other such connectors may be specifically adapted to lower power uses. Other similar connectors may be adapted for signal transmission. The user is required, therefore, to keep a relatively large stock of cable to board connectors for different uses.

There is a need, therefore, for a modular cable to board connector which can be specifically adapted for a particular need.

SUMMARY OF THE INVENTION

In the connector of the present invention, a modular cable to board connector is provided in which various configurations can be selected depending on the user's needs.

Each element of this electrical connector comprises a plurality of axial segments positioned in parallel, side by side relation and wherein a transverse passageway extends through said axial segments. A rail is positioned in said transverse passageway, and latching means are used to fix this rail to at least one of said axial segments. The segments may be a high power module, a low power module or a signal module. Guide modules are also provided on each of the opposed ends of the assembly.

BRIEF DESCRIPTION OF THE DRAWINGS

The invention is further described with reference to the accompanying drawings in which.

DETAILED DESCRIPTION OF THE PREFERRED EMBODIMENTS

Figure 1:
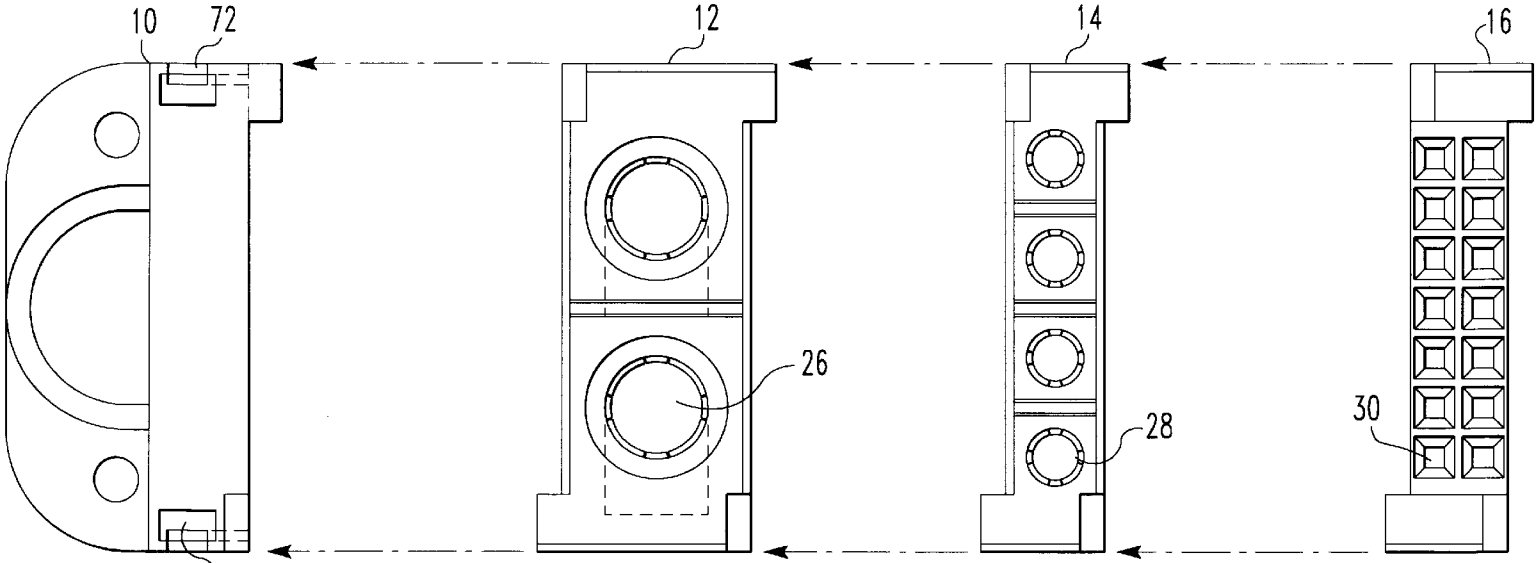
FIG. 1 is a front view of disassembled segments of a preferred embodiment of a board receptacle of the present invention.
Figure 2:
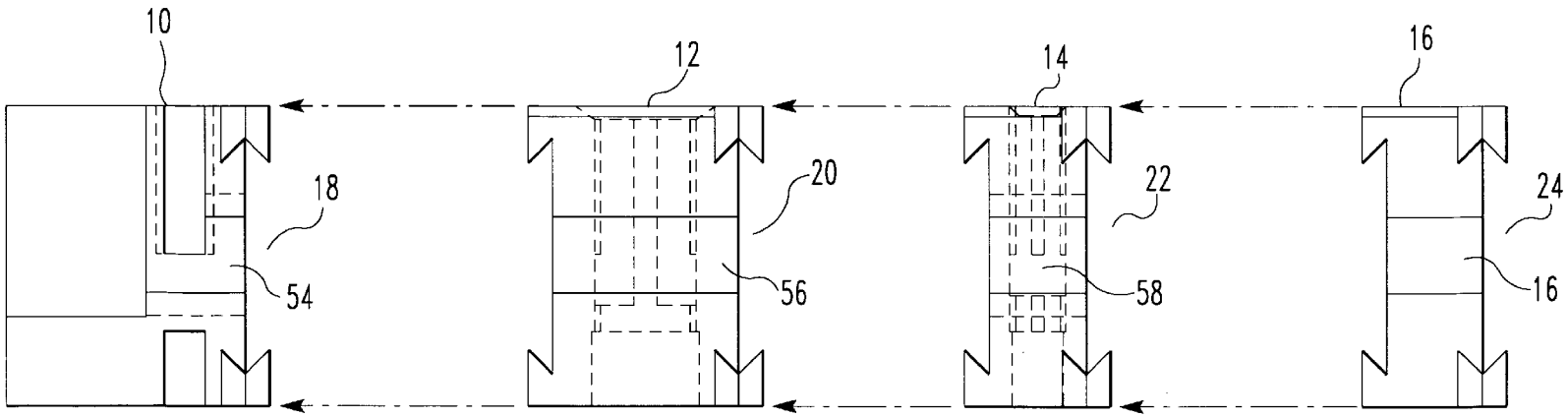
FIG. 2 is an end view of the segment shown in FIG. 1.

Referring to FIGS. 1–2, the board receptacle would be comprised, for example, of a guide module 10, a high power module 12, a low power module 14 and a signal module 16. Each of these modules would have locking features as, for example, 18, 20, 22, and 24. As is conventional, the high power module, low power module and signal module would each have contact receiving apertures such as, for example, respectively at apertures 26, 28 and 30.

It will be understood that it would be possible to substitute other segments for either the high power module, or the low power module depending on the specific needs of the user. One important consideration would be power requirements, and the type of power modules and number of power modules might be selected based on such requirements. It will also be understood that a second guide module would ordinarily be positioned to the opposed side of guide module 10 when the receptacle is assembled as will be described hereafter.

Figure 3:
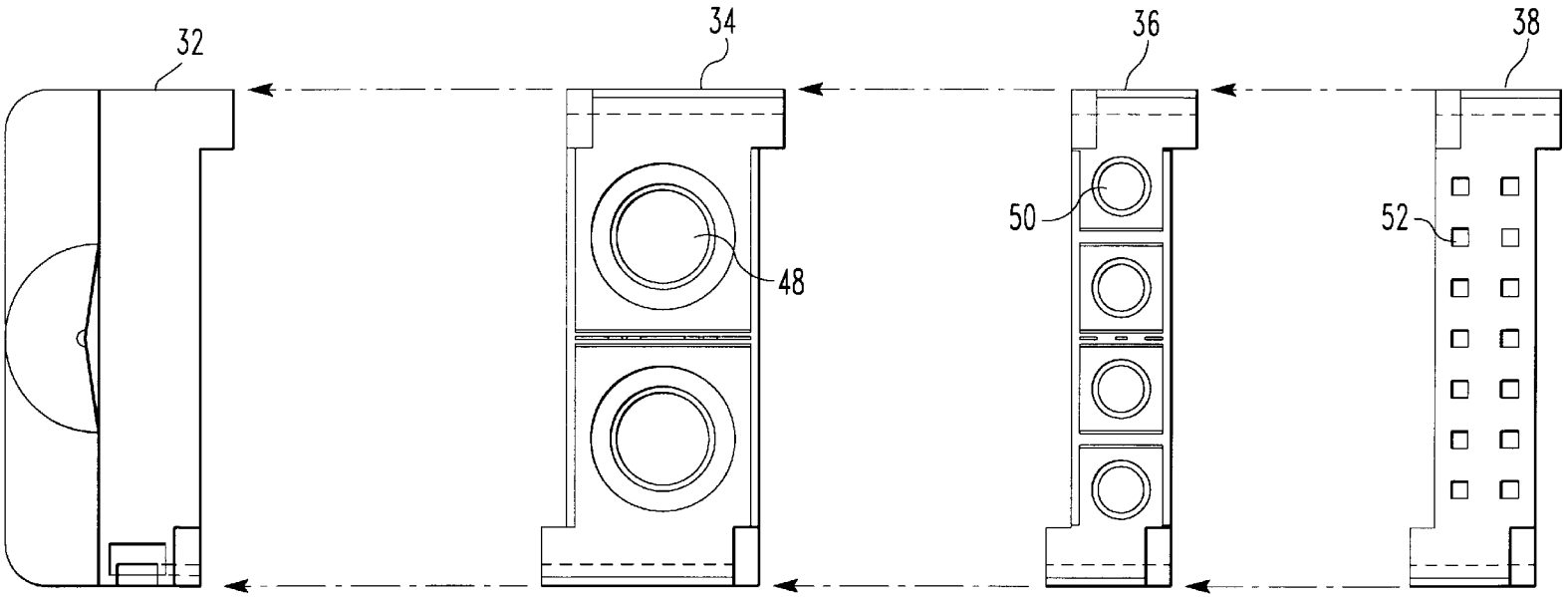
FIG. 3 is a front view of disassembled segments of a preferred embodiment of a cable plug of the present invention which plug may be mated with the board receptacle shown in FIG. 1.
Figure 4:
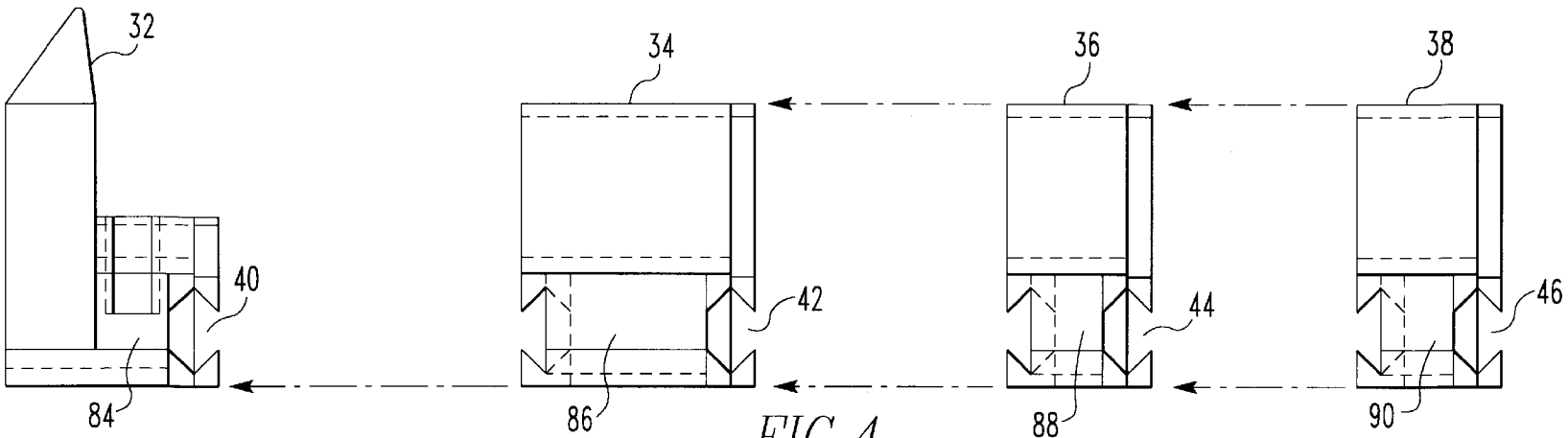
FIG. 4 is an end view of the disassembled segments shown in FIG. 3.

Referring to FIGS. 3–4, the board receptacle would be comprised, for example, of a guide module 32, a high power module 34, a low power module 36 and a signal module 38. Each of these modules would have locking features as, for example, 40, 42, 44 and 46. As is conventional, the high power module, low power module and signal module would each have contacts as is, for example, respectively shown at contacts 48, 50 and 52.

Figure 5:
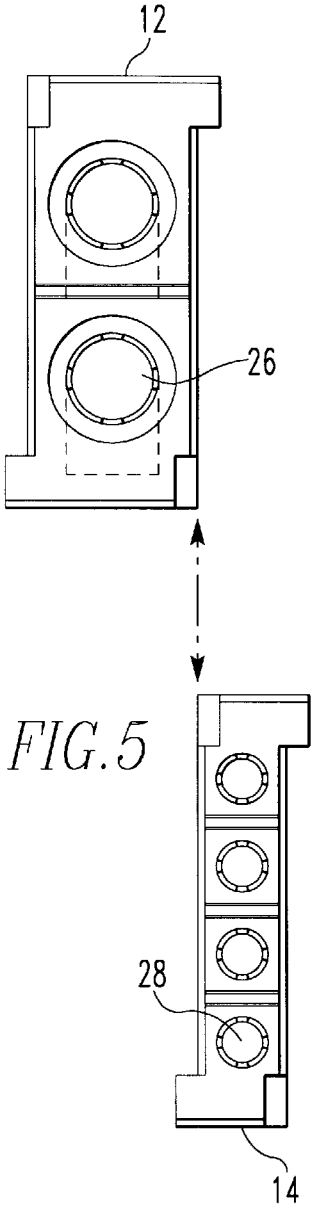
FIG. 5 is a front view illustrating the assembly of two segments shown in FIG. 1.
Figure 7:
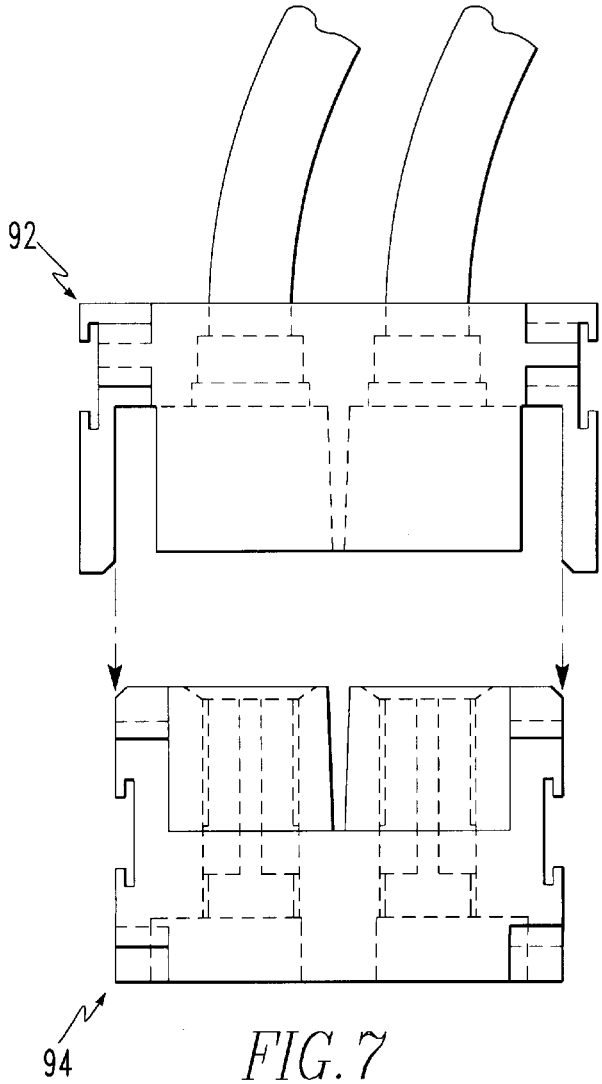
FIG. 7 is a top plan view of a receptacle and plug as would result from the assembly of the segments shown in FIGS. 1–4.
Figure 6:
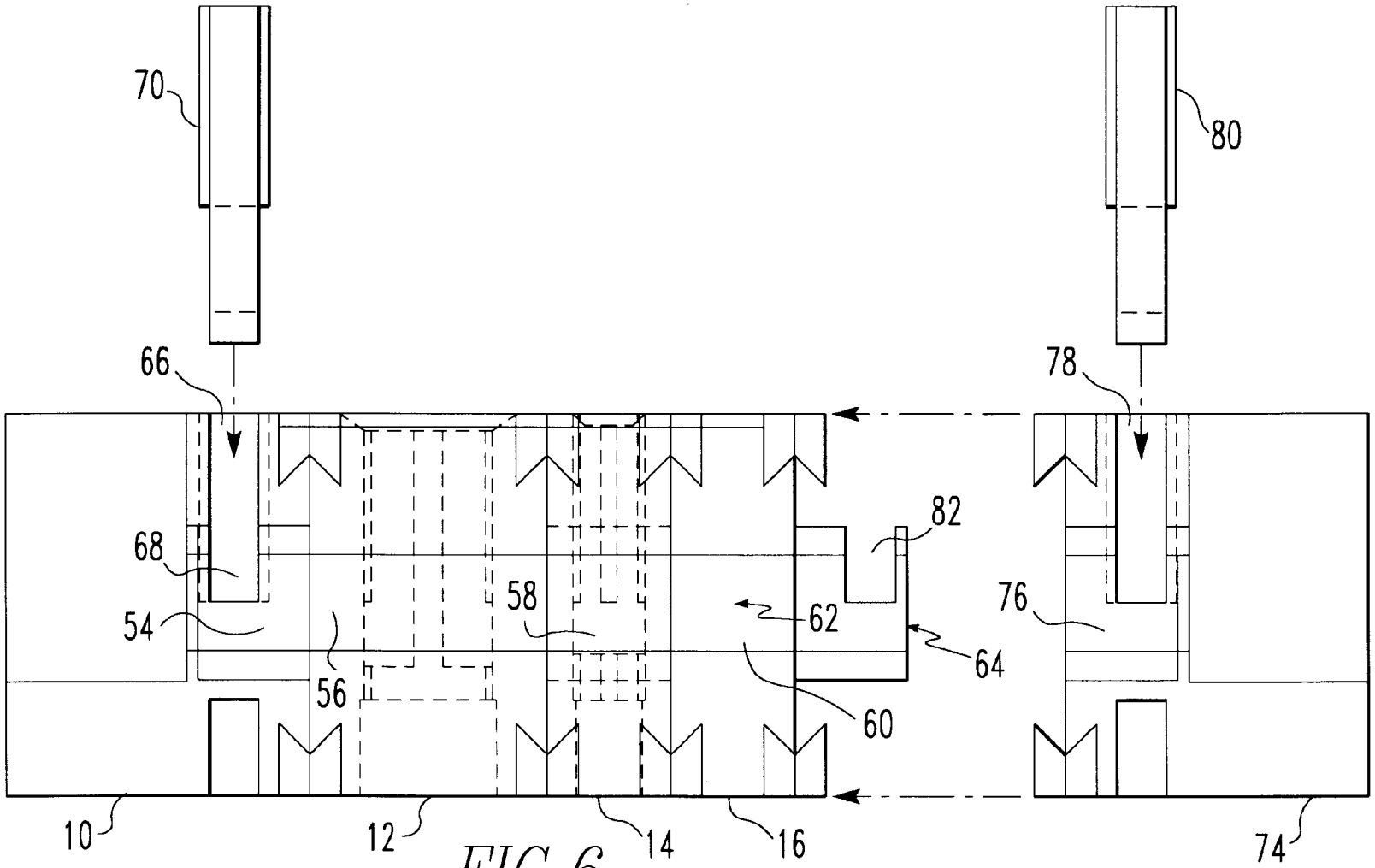
FIG. 6 is an end view of a partially assembled receptacle as shown in FIG. 1.

The assembly of the segments as are shown in FIGS. 1–4 is illustrated in FIGS. 5–7. From FIG. 5 it will be seen that adjacent segments as, for example, modules 12 and 14 initially slide together in the direction of the arrows. It will be understood that all adjacent segments slide together in a similar way to obtain a structure as, for example, as shown in FIG. 6. From FIGS. 2 and 6 it will be seen that the guide module 10 has a recess 54 and the high power module 12, low power module 14 and signal module 16 have respectively slots 56, 58 and 60 which are aligned to produce a passageway shown generally at 62. Referring particularly to FIG. 6, a locking rail 64 is positioned in the passageway 62. In the guide module there is vertical groove 66 which is aligned with a slot 68 in the locking rail. A vertical latch 70 is inserted in these aligned grooves to fix the locking groove to the guide module 10. A similar latch 72 (FIG. 1) serves a similar purpose on the opposed side of the guide module. On the other end of the assembly there is a second guide module 74 which also has a transverse recess 76 and a vertical groove 78. When a guide module 74 is positioned adjacent signal module 16, a latch 80 would engage groove 78 in the guide module and another groove 82 in the locking rail 64 to fix guide module 74 to the assembly.

Referring again to FIGS. 3 and 4, it will be seen that there is a recess 84 in the guide module 32 and slots 86, 88 and 90 respectively in the high power module 34, low power module 36 and signal module 38 which, when aligned, form a passageway (not shown) for a locking rail (not shown) to enable the entire plug to be assembled with latches (not shown) and another guide module (not shown) in a way similar to that described above.

Referring to FIG. 7, it will be seen that a plug shown generally at numeral 92 will be assembled to engage the receptacle shown generally at numeral 94 which is assembled in the way described above.

It will be appreciated that a cable to board connector has been described which may be assembled from modular components which may be high powered module, low powered module or signal module so that the specific needs of the user may be accommodated.

While the present invention has been described in connection with the preferred embodiments of the various figures, it is to be understood that other similar embodiments may be used or modifications and additions may be made to the described embodiment for performing the same function of the present invention without deviating therefrom. Therefore, the present invention should not be limited to any single embodiment, but rather construed in breadth and scope in accordance with the recitation of the appended claims.

What is claimed is:

1. An element of an electrical connector comprising:

(a) a plurality of axial segments positioned in side by side relation and wherein a transverse passageway extends through said axial segments, and said plurality of axial segments include two outer axial segments positioned at opposed ends of said element;

(b) a rail having opposed ends positioned in said transverse passageway; and (c) wherein the two outer axial segments positioned at opposed ends of said element are supporting guide modules, and the rail is fixed to said supporting guide modules, and there is a slot adjacent at least one end of the rail and there is a groove in at least one of the supporting guide modules and said slot and said groove are aligned and a latch passes through said groove and slot to fix the at least one end of the rail to the supporting guide module, and at least one of the axial segments is a high power module and at least one of the axial segments is a low power module and the selection of the number of power modules is based on power requirements, and at least one of the axial segments is a signal module and said signal module is interposed between said supporting guide modules.

2. The element of claim 1 which is a receptacle.

3. The element of claim 1 which is a plug.

4. The element of claim 1 wherein the transverse passageway is at least in part formed by aligned slots in at least some of said axial segments.

5. An electrical connector comprising:

(a) a board receptacle comprising:

(i) a plurality of axial receptacle segments positioned in side by side relation and wherein a transverse receptacle passageway extends through said axial receptacle segments and said receptacle passageway is formed from aligned slots in said axial receptacle segments, and said plurality of axial receptacle segments include two outer axial receptacle segments positioned at opposed ends of said board receptacle;

(ii) a receptacle rail having opposed ends positioned in said transverse receptacle passageway; and (iii) wherein the two outer axial receptacle segments positioned at opposed ends of said board receptacle are receptacle supporting guide modules, and the receptacle rail is fixed to said receptacle supporting guide modules, and there is a slot adjacent at least one end of the receptacle rail and there is a groove in at least one of the receptacle supporting guide modules and said slot and said groove are aligned and a receptacle latch passes through said groove and slot to fix the at least one end of the receptacle rail to the receptacle supporting guide module, and at least one of the axial receptacle segments is a receptacle high power module and at least one of the axial receptacle segments is a receptacle low power module and the selection of the number of power modules is based on power requirements, and at least one of the axial receptacle segments is a receptacle signal module and said receptacle signal module is interposed between said receptacle supporting guide modules; and (b) a cable plug mateable with said board receptacle comprising:

(i) a plurality of axial plug segments positioned in side by side relation and wherein a transverse plug passageway extends through said axial plug segments and said plug passageway is formed from aligned slots in said axial plug segments, and said plurality of axial plug segments include two outer axial plug segments positioned at opposed ends of said cable plug;

(ii) a plug rail having opposed ends positioned in said transverse plug passageway; and (iii) wherein the two outer axial plug segments positioned at opposed ends of said cable plug are plug supporting guide modules, and the plug rail is fixed to said plug supporting guide modules, and there is a slot adjacent at least one end of the plug rail and there is a groove in at least one of the plug supporting guide modules and said slot adjacent the at least one end of the plug rail and said groove in the at least one of the plug supporting guide modules are aligned and a plug latch passes through said groove in the at least one of the plug supporting guide modules and slot adjacent the at least one end of the plug rail to fix the at least one end of the plug rail to the plug supporting guide module, and at least one of the axial plug segments is a plug high power module and at least one of the axial plug segments is a plug low power module and the selection of the number of power modules is based on power requirements, and at least one of the axial plug segments is a plug signal module and said plug signal module is interposed between said plug supporting guide modules.

* * * * *